US006332260B1

(12) United States Patent
Sato et al.

(10) Patent No.: US 6,332,260 B1
(45) Date of Patent: Dec. 25, 2001

(54) APPARATUS AND METHOD OF FORMING AN ANNULAR MEMBER

(75) Inventors: Chuichi Sato; Hiroyuki Sawai; Hiroshi Mitsuboshi, all of Kanagawa (JP)

(73) Assignee: NSK Ltd., Tokyo (JP)

( * ) Notice: Subject to any disclaimer, the term of this patent is extended or adjusted under 35 U.S.C. 154(b) by 0 days.

(21) Appl. No.: 09/548,669

(22) Filed: Apr. 13, 2000

Related U.S. Application Data

(62) Division of application No. 08/705,645, filed on Aug. 30, 1996, now Pat. No. 6,070,443.

(30) Foreign Application Priority Data

Aug. 30, 1995 (JP) ..... 7-221902

(51) Int. Cl.[7] ..... B23Q 17/00
(52) U.S. Cl. ..... 29/407.05; 29/407.01; 29/407.09; 72/368; 72/370.14
(58) Field of Search ..... 29/505, 509, 898.066, 29/407.01, 407.05, 407.09; 72/105, 110, 111, 11.1, 12.8, 108, 82, 8.9, 11.6, 12.7, 13.1, 19.7, 19.6, 368, 370.14

(56) References Cited

U.S. PATENT DOCUMENTS

| | | | |
|---|---|---|---|
| 1,976,927 | 10/1934 | Eckert | 72/105 |
| 3,709,011 | 1/1973 | Wieting et al. | 72/9.5 |
| 3,839,887 | 10/1974 | Vieregge | 72/110 |
| 3,859,830 | 1/1975 | Jeuken et al. | 72/110 |
| 3,902,345 | 9/1975 | Shida | 72/8 |
| 4,326,397 | 4/1982 | Strugala et al. | 72/110 |
| 4,454,739 | 6/1984 | Ciccorelli | 72/13.7 |
| 4,823,580 | 4/1989 | Kadotani | 72/105 |
| 4,823,581 | 4/1989 | Kadotani | 72/105 |
| 4,869,088 | 9/1989 | Kadotani | 72/10 |
| 5,605,068 | 2/1997 | Yamasoto et al. | 72/105 |
| 5,829,292 * | 11/1998 | Andriessen | 72/110 |
| 6,070,443 * | 6/2000 | Sato et al. | 72/11.1 |
| 6,240,761 * | 6/2001 | Suzuki et al. | 72/106 |

FOREIGN PATENT DOCUMENTS

| | | | |
|---|---|---|---|
| 292616 | 8/1991 | (DE) | 72/105 |
| 51-140292 | 12/1976 | (JP) | B24B/47/18 |
| 51-143983 | 12/1976 | (JP) | B24B/5/10 |
| 52-6193 | 1/1977 | (JP) | B24B/4/00 |
| 54-6856 | 1/1979 | (JP) | 72/13.1 |
| 58-38614 | 3/1983 | (JP) | 72/111 |
| 61-173851 | 8/1986 | (JP) | B24B/5/06 |
| 61-242737 | 10/1986 | (JP) | 29/505 |

(List continued on next page.)

*Primary Examiner*—S. Thomas Hughes
*Assistant Examiner*—Essama Omgba
(74) *Attorney, Agent, or Firm*—Sughrue Mion, PLLC

(57) ABSTRACT

In an annular member forming apparatus including: a forming roll rotatable in contact with an outer cylindrical surface of an annular workpiece; a mandrel relatively movable towards and away from the forming roll in contact with an inner cylindrical surface of the workpiece; and an outside diameter detecting device for detecting an outside diameter of the workpiece which is to be worked, the apparatus further includes a moving device for moving relatively the forming roll and the mandrel and for pressing the workpiece by the forming roll and the mandrel moved towards each other to subject the workpiece to rough rolling and to finish rolling. The moving device includes a retracting device for correcting an elastic deformation of the forming roll, the mandrel and the moving device occurring during the rough rolling, for a switching time from the rough rolling to the finish rolling by an output signal from the outside diameter detecting device. The moving device is moved backwardly away from the mandrel by a distance corresponding to a difference between amounts of elongation which are due to a rolling load during the rough rolling and due to a rolling load during the finish rolling for the switching time.

3 Claims, 7 Drawing Sheets

FOREIGN PATENT DOCUMENTS

| | | | |
|---|---|---|---|
| 62 176627 | 8/1987 | (JP) | B21H/1/02 |
| 64 62238 | 3/1989 | (JP) | B21H/1/06 |
| 1-157736 | 6/1989 | (JP) | 72/110 |
| 1 313122 | 12/1989 | (JP) | B21H/1/06 |
| 2-25236 | 1/1990 | (JP) | 72/110 |
| 3-281026 | 12/1991 | (JP) | B21H/1/06 |
| 4-182005 | 6/1992 | (JP) | 72/110 |
| 4-53666 | 8/1992 | (JP) | B24B/47/20 |
| 5-162068 | 6/1993 | (JP) | B24B/49/10 |
| 5-39744 | 6/1993 | (JP) | B24B/49/04 |
| 5 45338 | 7/1993 | (JP) | B21H/1/12 |
| 6-31625 | 2/1994 | (JP) | B24B/47/20 |
| 6-71316 | 3/1994 | (JP) | 72/8.9 |
| 7-136730 | 5/1995 | (JP) | B21H/1/06 |
| 479550 | 8/1975 | (SU) | 72/8.9 |
| 1159700 | 6/1985 | (SU) | 29/898.066 |
| 1449212 | 1/1989 | (SU) | 72/105 |
| 578146 | 10/1997 | (SU) | 72/105 |
| 85/00765 | 2/1985 | (WO) | 72/111 |

* cited by examiner

APPARATUS AND METHOD OF FORMING AN ANNULAR MEMBER

This is a divisional of application Ser. No. 08/705,645 filed Aug. 30, 1996, now U.S. Pat. No. 6,070,443 the disclosure of which is incorporated herein by reference.

BACKGROUND OF THE INVENTION

The present invention relates to an annular member forming method in which an annular member such as inner and outer races of bearings is formed by cold rolling, and an apparatus for practicing the method (hereinafter referred to as "an annular member forming method", when applicable).

A conventional apparatus and method of forming an annular member have been disclosed, for instance, by Examined Japanese Patent Publication No. Hei. 5-45338.

The conventional annular member forming apparatus, as shown in FIG. 7, essentially includes a mandrel 30 which is rotated at a predetermined position, and a forming roll 31 which is rotated around a shaft which is in parallel with the rotary shaft of the mandrel 30. The forming roll 31 is movable towards and away from the mandrel 30. The forming roll 31 is pressed against an annular workpiece W which has been put on the mandrel 30. Under this condition, the forming roll 31 is rotated and the mandrel 30 is axially rotated with the rotation of the forming roll 31 while the workpiece W is pressed by the mandrel 30 and the forming roll 31 from inside and outside. Hence, the workpiece W is rolled to increase the diameter of the workpiece W. In FIG. 7, a supporting roll 32 supports a load applied to the mandrel 30.

The apparatus further includes a detecting lever 33 which is brought into slide contact with the outer cylindrical surface of the annular workpiece W, and a sensor 34 for detecting the amount of displacement of the detecting lever 33. The outside diameter of the workpiece W which is being rolled is detected by the sensor 34 in cooperation with the detecting lever 33. In the above-described conventional apparatus, the output detection signal of the sensor 34 is applied to a low-pass filter 35, where it is smoothed, and the signal thus smoothed is compared with a predetermined value to detect the completion of the rolling operation, so that the outside diameter of a workpiece W is matched with the average diameter of the workpiece W at the end of the rolling operation.

A conventional annular member forming method using the above-described annular member forming apparatus is described as follows: As shown in FIG. 10, the forming roll 31 is moved towards the mandrel 30 at a high speed in accordance with an instructed amount of depression in rough rolling, the workpiece W is subjected to rough rolling under a predetermined rolling load until the outside diameter of the workpiece W is increased to a predetermined threshold value dc. Next, the forming roll 31 is moved towards the mandrel 30 at a speed lower than the aforementioned high speed (at which the forming roll 31 was moved during rough rolling), and under this condition the workpiece W is subjected to finish rolling under a rolling load smaller than the aforementioned rolling load (under which the workpiece was subjected to rough rolling).

Furthermore, after the workpiece is rolled on the conventional annular member forming apparatus, the workpiece w formed by rolling in the above-described manner is subjected to sizing, as shown in FIG. 8. That is, it is press-fitted into a sizing die 36 to correct the roundness and/or finish dimension of the workpiece W, so that the required workpiece W having high accuracy can be obtained.

A workpiece rolling operation with the conventional annular member forming apparatus will be described in more detail. In the above-described rough rolling operation, as shown in FIGS. 9 and 10, the forming roll 31 is moved towards the mandrel 30 at the predetermined high speed so that the forming roll 31 approaches the mandrel 30, and under this condition the workpiece W is rolled under a high rolling load, so that the workpiece diameter increasing speed is accelerated. In this operation, the annular member forming apparatus is elastically deformed, or elongated, by the high rolling load. Hence, the actual amount of depression of the workpiece W is obtained by subtracting the amount of elongation of the apparatus from the instructed amount of depression. Further, when the outside diameter of the workpiece W reaches the threshold value dc; that is, at the end of the rough rolling operation, the rolling load is a maximum value Pmax.

Under this condition, in order to decrease the amount of depression per revolution of the workpiece W thereby to improve the roundness of the workpiece W, the feeding speed of the forming roll 31 is decreased to switch the rough rolling operation over to a finish rolling operation. At that time, the rolling load is not immediately switched over to a finish rolling load Pf from the aforementioned Pmax. This is because the apparatus elongated in correspondence to the rough rolling load Pmax needs a transient period of time until it is elongated in correspondence to a finish rolling load Pf. After the transient period of time, the rolling load becomes steady, thus reaching the value Pf. Further, when it is detected that the outside diameter of the workpiece reaches a predetermined value df, the rolling operation is ended.

As described above, in the conventional annular member forming operation, the transient period of time is present which is due to the fact that the apparatus is elongated in proportion to the rolling load. Hence, there is a time lag in response to the switching from the rough rolling to the finish rolling. That is, the conventional annular member forming operation suffers from a problem that the finishing rolling time is lengthened as much as the above-described transient period of time.

Hence, if the rolling time is shortened; that is, if the finish rolling time is decreased, the rolling of the workpiece may be ended during the transient period of time. In this case, the speed of depression is not sufficiently low yet. Therefore, the amount of depression per revolution of the workpiece W is so large that the resultant workpiece is low in roundness. Hence, it is necessary to subject the workpiece to sizing in the above-described manner, so that the dimension and roundness of the workpiece are corrected to fall within the predetermined allowable ranges.

For instance if the difference between the threshold diameter dc at which the rough rolling operation is switched over to the finish rolling operation and the required outside diameter df of the workpiece is small, then the outside diameter of the workpiece W may reach the required outside diameter df during the transient period of time because the increasing speed of the workpiece diameter is not immediately decreased during the transient period of time.

As is apparent from the above description, in then conventional annular member forming method, an intention of shortening the working time to improve the productivity of the annular member is not compatible with an intention of improving the accuracy of the annular member.

SUMMARY OF THE INVENTION

It is an object of the present invention to provide an annular member forming method which is capable of shortening the working time and improving the workpiece in accuracy, and an annular member forming, apparatus for practicing the method.

The foregoing object of the invention has been achieved by an annular member forming apparatus which includes: a rotatable forming roll in contact with an outer cylindrical surface of an annular workpiece; a mandrel movable relatively towards and away from the forming roll and confronting the forming roll in contact with an inner cylindrical surface of the annular workpiece; an outside diameter detecting device for detecting an outside diameter of the annular workpiece which is to be worked; and a moving device for moving relatively the forming roll and the mandrel to sandwhich the annular workpiece between the forming roll and the mandrel to subject the annular workpiece to rough rolling and to finish rolling, in which the moving device includes a retracting device for compensating for elastic deformation of the annular member apparatus including the forming roll, the mandrel and the moving device occurring during a change from the rough rolling, to the finish rolling the change being determined by an output signal from the outside diameter detecting device.

Further, the object of the invention has also been achieved by an annular member forming method of forming an annular workpiece which is pressed between a forming roll and a mandrel moved towards and away from each other by a moving device, in an annular member forming apparatus in which the method includes the steps of: rough rolling the annular workpiece at a first feed speed of moving the forming roll and the mandrel towards each other; finish rolling the annular workpiece at a second feed speed which is lower than the first feed speed; and separating the forming roll and the mandrel by a distance corresponding to a difference between the elastic deformation of the apparatus due to a first rolling load during the rough rolling and due to a second rolling load during the finish rolling, in which the separating step is carried out during the change from the rough rolling to the finish rolling.

With the annular member forming method, when the rough rolling operation is switched over to the finish rolling operation, the moving device is moved backwardly by the retracting device. As a result, the elastic deformation of the apparatus which is due to the rolling load applied thereto at the end of the rough rolling operation is corrected as much as the aforementioned backward movement, so that the elastic deformation of the apparatus approaches that of the apparatus which, is due to the rolling load applied thereto during the finish rolling operation. Further, the transient period of time is shortened in which the elastic deformation of the apparatus is changed into that of the apparatus which is due to the fishing rolling load.

Hence, the time required for the finish rolling operation is shorter than in the conventional method and apparatus, with the working accuracy maintained high.

According to the annular member forming method, the distance for moving backwardly the moving device is determined in correspondence to the difference between the elastic deformation of the apparatus which is due to the rolling load applied thereto during rough rolling, and the elastic deformation of the apparatus which is due to the rolling load applied thereto during finish rolling. Hence, the rolling load applied thereto at the start of the finish rolling operation may be set to a value which is substantially equal to the required finish rolling load, so that the transient period of time can be substantially eliminated.

The fact of eliminating or substantially eliminating the transient period of time is that it can maintain the increase in diameter of the workpiece to be zero or extremely small during the transient period of time. Hence, even if the threshold diameter which is a reference value for switching from the rough rolling operation to the finish rolling operation is close to the required outside diameter of the workpiece (annular member), the workpiece can be rolled with high accuracy.

DETAILED DESCRIPTION OF THE PREFERRED EMBODIMENT

One preferred embodiment of the invention will be described with reference to the accompanying drawings.

Figure 1:
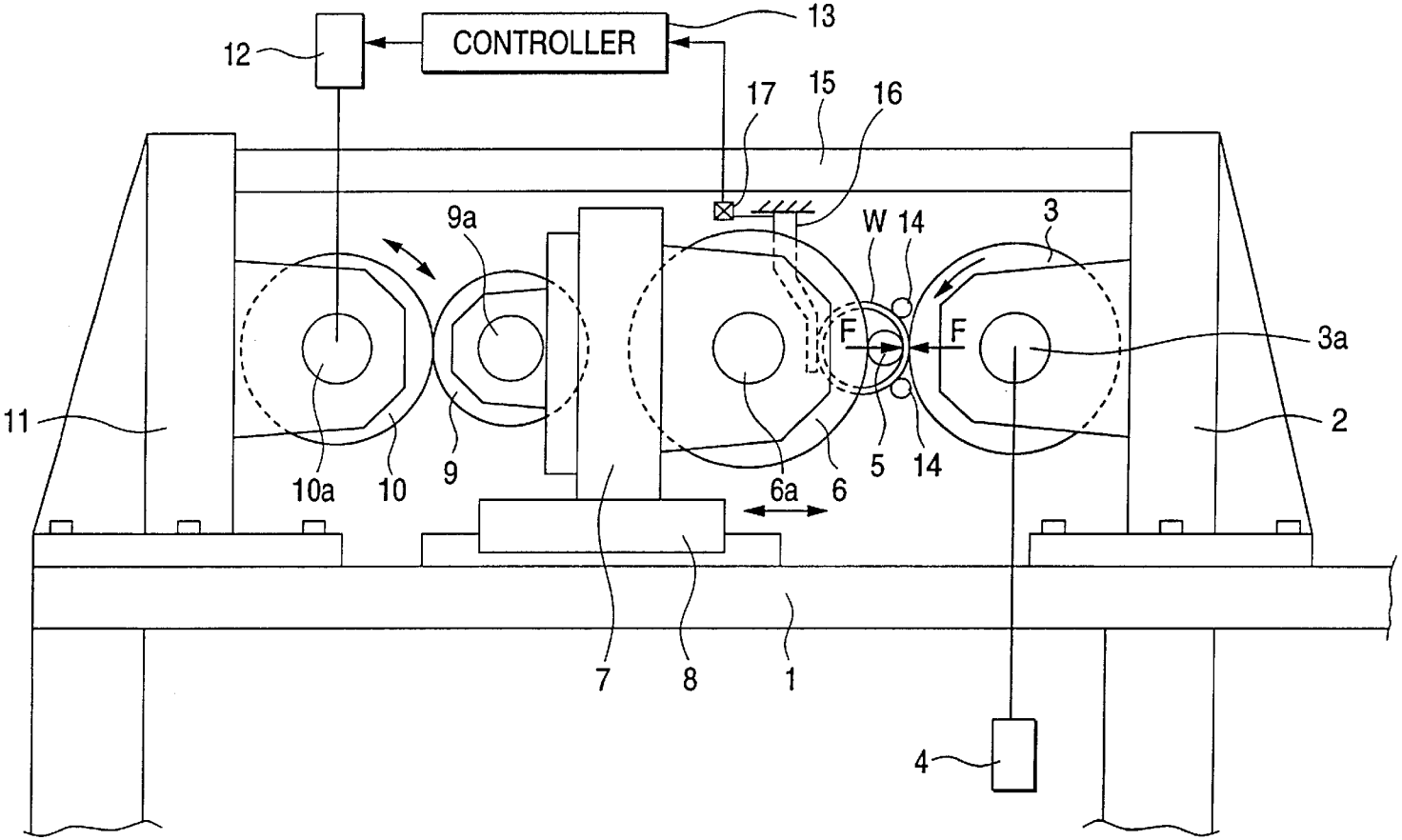
FIG. 1 is a diagram showing an annular member forming apparatus of a preferred embodiment of the present invention.

FIG. 1 outlines the arrangement of an annular member forming apparatus which is the embodiment of the invention. That is, the rotary shaft 3*a* of a forming roll 3 is rotatably supported on the right block 2 fixedly secured to the right side portion of a bed 1. In the middle of the outer cylindrical surface of the forming roll 3, an annular member forming section is provided in such a manner that it is extended along the circumference of the outer cylindrical surface. The rotary shaft 3*a* of the forming roll 3 is coupled to a driving motor 4, so that the forming roll 3 is turned by the driving motor 4.

A mandrel 5 is positioned on the left side of the forming roll 3. The mandrel 5 is rotated around an axis which is in parallel with the rotary shaft 3*a* of the forming roll 3, and it is movable towards and away from the forming roll 3. In the middle of the outer cylindrical surface of the mandrel 5, an annular member forming section is provided in such a manner that it is also extended along the circumference of the outer cylindrical surface.

A supporting roll 6 is provided on the left side of the mandrel 5 in such a manner that the supporting roll 6 is in contact with the mandrel 5. That is, the mandrel 5 is moved towards and away from the forming roll 3 by the supporting roll 6. The rotary shaft 6*a* of the supporting roll 6 is rotatably supported by a supporting block 7 which is provided on the left side of the supporting roll 6. The supporting block 7 is supported through a slider 8 on the bed 1 in such a manner that it is slidable in the same direction as the mandrel 5 is moved.

Figure 2:
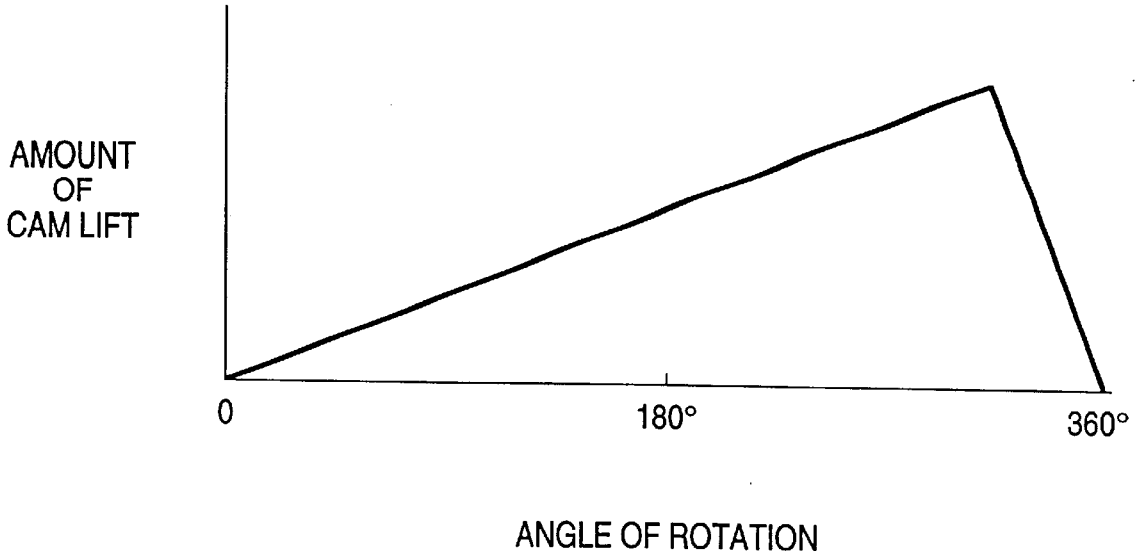
FIG. 2 is a graphical representation indicating angles or rotation of a cam and amounts of lift of the cam.

The shaft 9*a* of a cylindrical cam follower 9 is rotatably mounted on the left end portion of the supporting block 7. A cam 10 is provided on the left side of the cam follower 9 in such a manner that the cam 10 is in contact with the cam follower 9. The rotary shaft 10*a* of the cam 10 is rotatably supported by the left block 11 fixedly mounted on the bed 1. The cam 10, as shown in FIG. 2, provides a cam lift the amount of which is primarily proportional to the angle of rotation of the cam; that is, the cam 10 presses the cam follower 9 to move the cam follower 9 towards the forming roll 3 according to the angle of rotation thereof. Hereinafter, the rotation of the cam 10 which increases the amount of cam lift will be referred to as "forward rotation", when applicable; and the rotation of the cam 10 which decreases the amount of cam lift will be referred to as "reverse rotation", when applicable.

The rotary shaft 10*a* of the cam 10 is coupled to a cam driving motor 12 which is a servo motor; that is, the speed of rotation, the amount of rotation, and the direction of rotation of the cam are controlled by the cam driving motor 12. The driving of the motor 12 is controlled in response to a drive signal from a controller 13.

In FIG. 1, a pair of guide rollers 14 are rollingly in contact with a workpiece W which is put on the mandrel to retain the correct attitude of the workpiece W which is being rolled. A tie rod 15 connects the right and left blocks 2 and 11 to each other to reinforce them.

Further in FIG. 1, an outside diameter detecting lever 16 forms an outside diameter detecting device. The lever 16 is held in slide contact with the outer cylindrical surface of the workpiece W, thus being deflected in proportion to the increase in outside diameter of the workpiece W. A deflection sensor 17 detects the amount of deflection of the lever 16, to output a detection signal proportional to the outside diameter of the workpiece thus detected. The detection signal thus outputted is applied to the controller 13.

Figure 3:
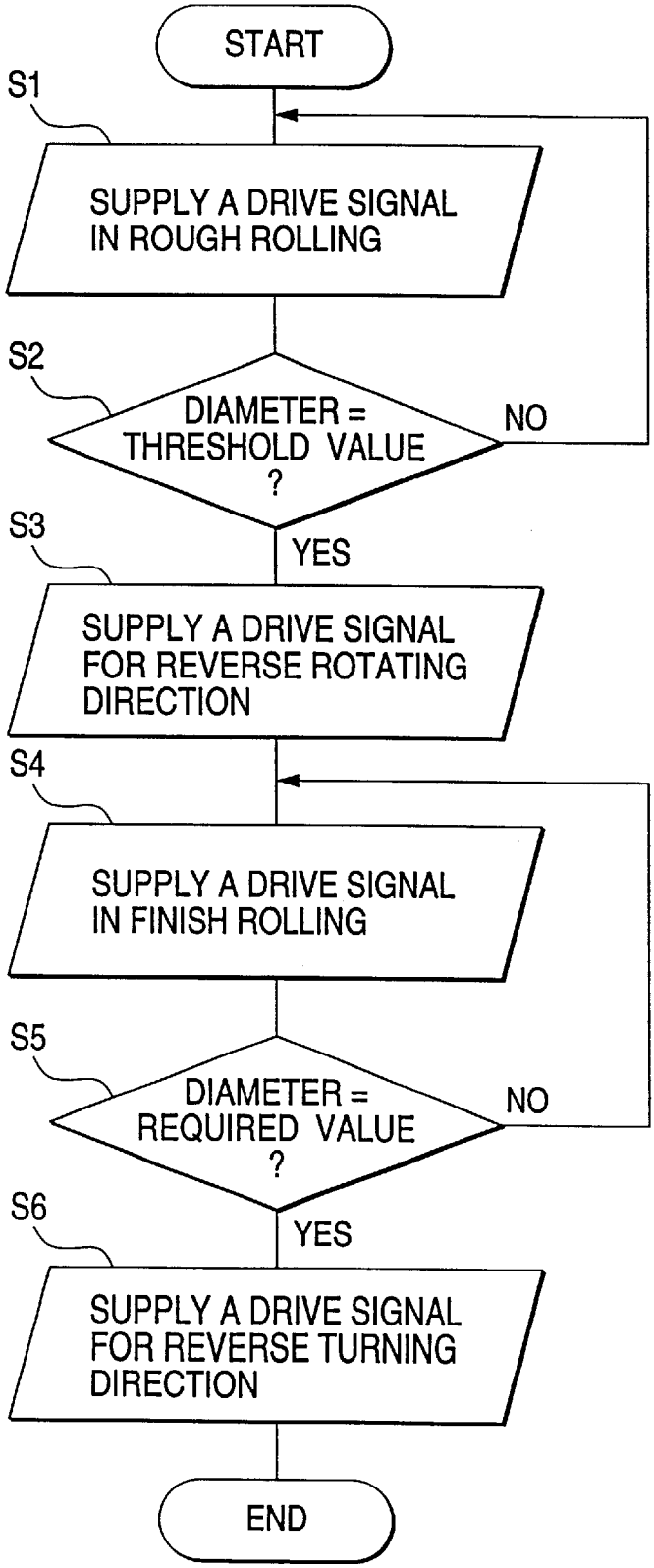
FIG. 3 is a flow chart for description of the operation of a controller in the apparatus of the present invention.
Figure 4:
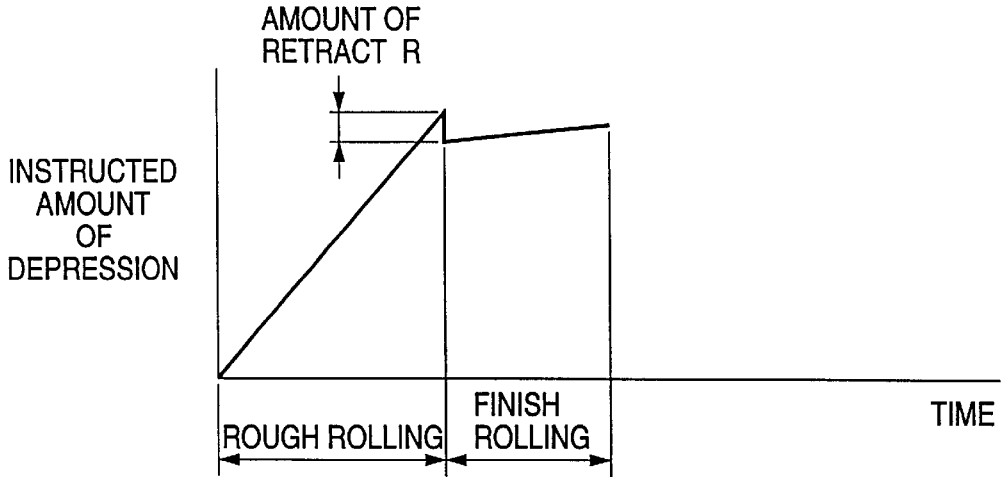
FIG. 4 is a graphical representation for a description of variations in the amount of depression as an instruction value in the apparatus of the present invention.

The controller 13 operates according to a flow chart of FIG. 3. That is, until it is detected from the output signal of the sensor 17 that the outside diameter of the workpiece W has reached the threshold value dc, as shown in FIG. 4 a drive signal is supplied to the cam driving motor 12 to rotate the cam 10 in the forward direction at a speed in accordance with an instructed amount of depression in rough rolling (step S1). At the time that it is detected from the output signal of the sensor 17 that the outside diameter of the workpiece W has reached the threshold value (step S2), a drive signal is applied to the cam driving motor 12 to rotate the cam 10 in the reverse direction by an angle of rotation corresponding to an amount of cam lift which is equal to a predetermined amount of retraction R (step S3). Thereafter, a drive signal is supplied to the cam driving motor 12 again to rotate the cam 10 in the forward direction at a speed which is lower than the aforementioned rough-rolling feed speed and is based on an instructed amount of depression in finish rolling (step S4). Thereafter, at the time instant that it is detected from the output signal of the sensor 17 that the outside diameter of the workpiece W has reached the required value (step S5), a drive signal is supplied to the cam driving motor 12 to turn the cam 10 in the reverse direction (step S6).

Figure 6:
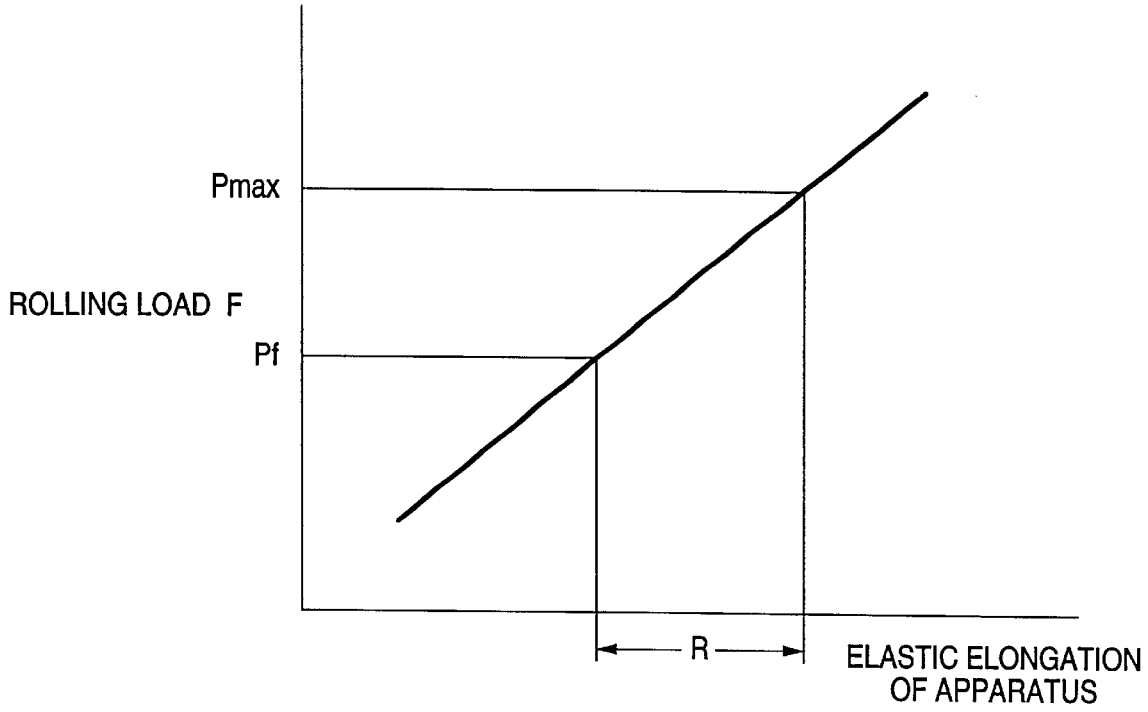
FIG. 6 is a graphical representation indicating relationships between rolling loads and amounts of elongation of the apparatus.
Figure 7:
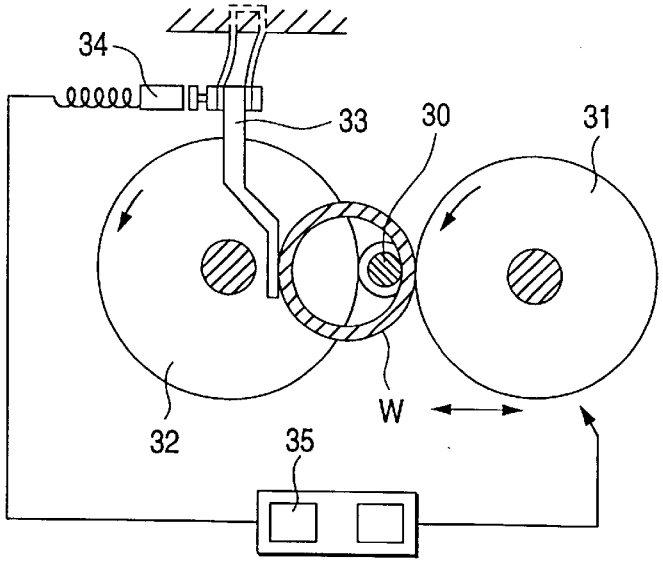
FIG. 7 is an explanatory diagram showing a conventional annular member forming apparatus.
Figure 8:
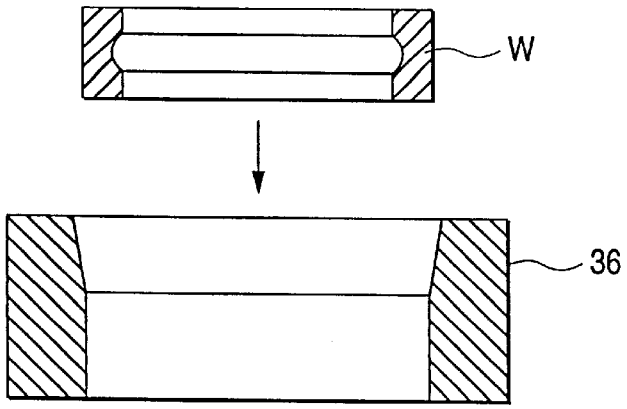
FIG. 8 PRIOR ART
FIG. 8 is a diagram for a description of a step of sizing a workpiece.
Figure 9:
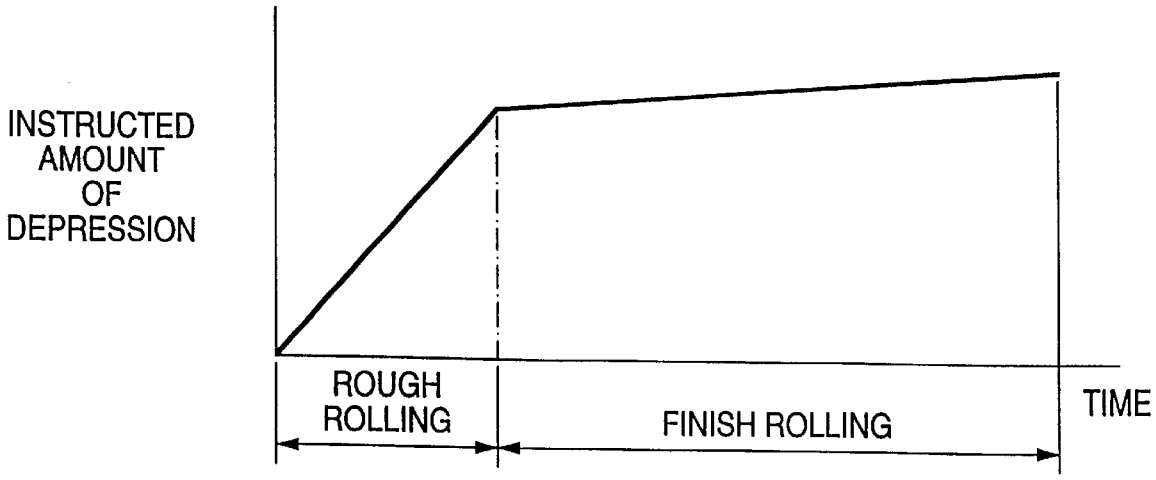
FIG. 9 PRIOR ART
FIG. 9 is a graphical representation indicating variations in the amount of depression as the instruction value in a conventional annular member forming method.
Figure 10:
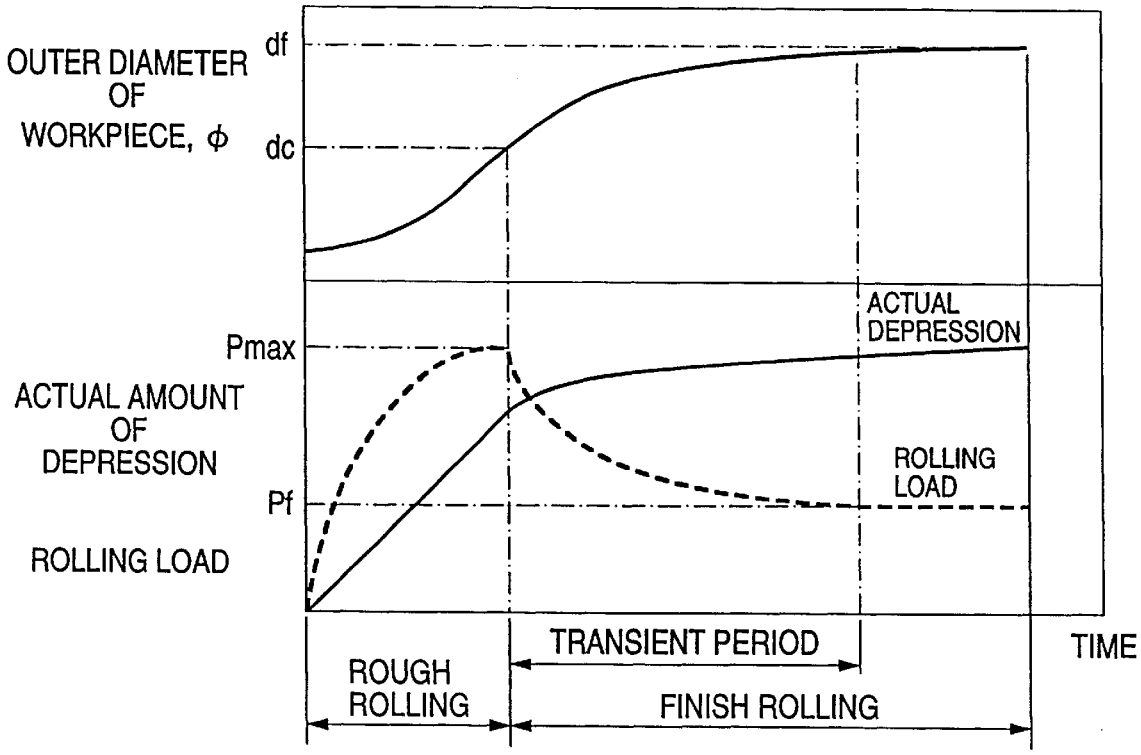
FIG. 10 PRIOR ART
FIG. 10 is a graphical representation indicating relationships between rolling loads, actual amounts of depression, and outside diameters of a workpiece in a rough rolling operation and a finish rolling operation in the conventional annular member forming method.

The aforementioned amount of retraction R is set to a value corresponding to the difference between the amount of deformation of the apparatus which is due to the rolling load Pmax applied thereto at the end of the rough rolling operation and the amount of deformation of the apparatus which is due to the rolling load Pf (cf. FIG. 6) applied thereto during the finish rolling operation. The amount of retraction R is obtained in advance for instance as follows: while the corresponding loads are applied to the apparatus, the amounts of deformation of the apparatus are actually detected.

The above-described supporting roll 6, supporting block 7, cam follow 9, cam 10, cam driving motor 12, and controller 13 form a moving device. The above-described step S3 is carried out by a retracting device.

Now, the operation of the annular structuring forming apparatus will be described.

First, an annular workpiece W is put on the mandrel 5 in such a manner that the mandrel 5 is in contact with the inner cylindrical surface of the workpiece W. On the other hand, the pair of guide rollers 14 are rollingly set in contact with the outer cylindrical surface of the workpiece W, so that the workpiece W is retained to a predetermined rolling attitude so as to be worked with high accuracy.

The outside diameter detecting lever 16 is held in contact with the outer cylindrical surface of the workpiece W.

Figure 5:
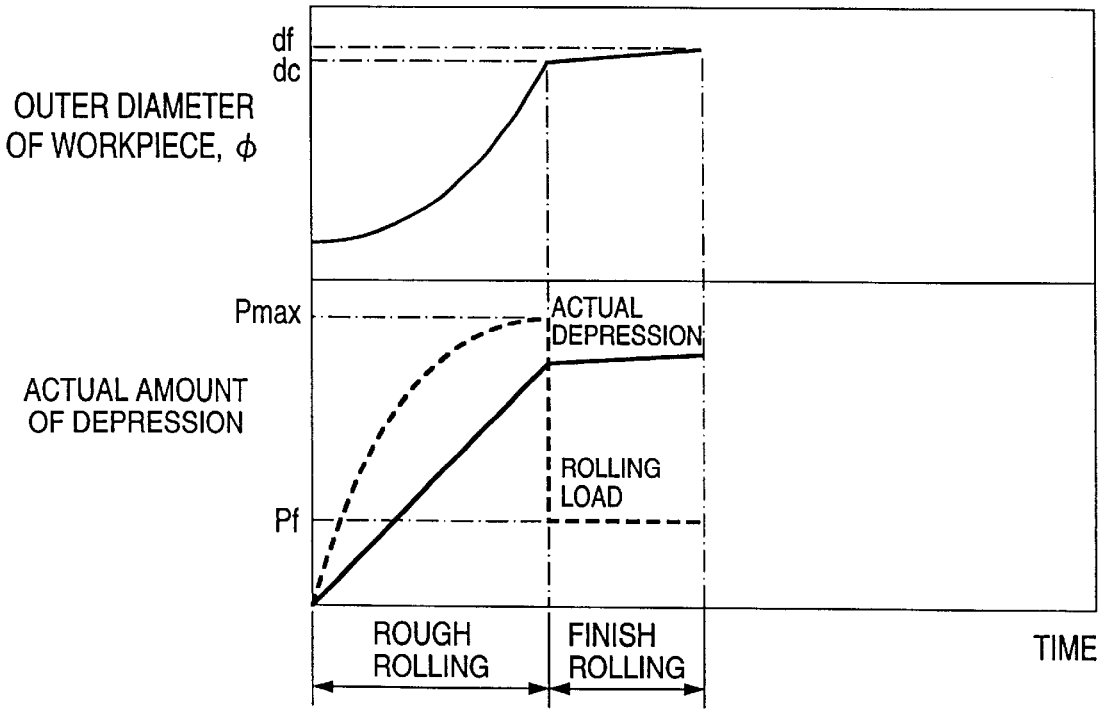
FIG. 5 is a graphical representation indicating relationships between rolling loads, actual amounts of depression, and outside diameters of a workpiece in a rough rolling operation and a finish rolling operation.

Next, the motor 4 for rotating the forming roll 3 is driven while the controller 13 is activated. As shown in FIGS. 4 and 5, the controller 13 operates to rotate the cam 10 in the forward direction through the cam driving motor 12 at a speed in accordance with the instructed amount of depression in rough rolling. Further, the cam follower 9 is moved at a feed speed corresponding to the speed of rotation of the cam 10. Accordingly, the mandrel 5 is moved towards the forming roll 3 through the supporting roll 6 and the supporting block 7 at a feed speed in accordance with the instructed amount of depression in rough rolling. Thus as shown in FIG. 5, the workpiece W is pressed between the mandrel 5 and the forming roll 3 under a high rolling load in accordance with the speed of movement of the mandrel.

Hence, the torque of the forming roll 3 is transmitted through the workpiece W to the mandrel 5, so that the mandrel 5 is axially rotated. That is, the forming roll 3 and the mandrel 5 are rotated while pressing the workpiece from both sides (from inside and outside); that is, the workpiece is subjected to rough rolling so as to increase the diameter of the workpiece.

During this operation, a forming load F is produced between the forming roll 3 and the mandrel 5. The forming load F is applied to the supporting roll 6 supporting the mandrel 5 and further transmitted to the rotary shaft 10*a* of the cam 10 through the cam follower 9. The reaction force of the forming load F is supported by the frame (made up of the bed 1, the right block 2, the left block 11 and the tie rod 15) of the apparatus which supports the shaft 3*a* of the forming roll 3 and the rotary shaft 10*a* of the cam 10. The forming load acts to elastically deform the forming roll 3, the mandrel 5, the supporting roll 6, the cam follower 9, the cam 10, and the aforementioned frame. Accordingly, the actual amount of depression is obtained by subtracting the amount of deformation due to the aforementioned elastic deformation from the instructed amount of depression.

On the other hand, the rough rolling operation is advanced. Hence, when it is detected from the output signal of the sensor 17 that the diameter of the workpiece W has reached the threshold value dc, the controller 13 decides that the rough rolling operation has been accomplished, and applies a drive signal to the cam driving motor 12 to turn the cam driving motor 12 in the reverse direction by an angle of rotation corresponding to the amount of retraction R. As the cam 10 is turned in the reverse direction, the cam follower 9 and the supporting block 7 are moved backwardly to the left in FIG. 1, so that the forming roll 3, the mandrel 5, the support roll 6, the cam follow 9, the cam 10, and the frame of the apparatus are reduced in the amount of elastic deformation as much as the amount of retraction R. During this operation, the mandrel 5 is not moved backwardly so that the position of the mandrel 5 is maintained with respect to the forming roll 3.

The rolling load is decreased by the aforementioned backward movement. Therefore, those members which have been elastically deformed are elastically restored, thus being decreased in the amount of elongation. In this connection, as described before, the amount of retraction is set to the difference between the amount of deformation which is due to the rolling load applied thereto at the end of the rough rolling and the amount of deformation which is due to the rolling load during the finish rolling operation. Accordingly, the elastic deformation is the amount of deformation corresponding to the finish rolling load by the aforementioned backward movement. The rolling load F becomes equal to the finish rolling load Pf, or approaches the finish rolling load Pf.

Next, the controller 13 supplies a drive signal to the cam driving motor 12 again to rotate the rotary shaft 10*a* of the cam 10 in the forward direction at a speed of rotation corresponding to a finish rolling feed speed.

By the supplied drive signal, the mandrel 5 is moved through the cam follower 9 and the supporting roll 6 towards the forming roll 3 at the finish rolling feed speed which is lower than the rough rolling feed speed, thus rolling the workpiece W under the preset finish rolling load Pf. In this operation, the finish rolling operation is carried out by the above-described backward movement under the preset finish rolling load Pf from the beginning.

On the other hand, the finish rolling operation is advanced. When it is detected from the output signal of the sensor 17 that the diameter of the workpiece W has reached the required value df, the controller 13 determines that the finish rolling operation has been accomplished, and supplies a drive signal to the cam driving motor 12 to turn the cam driving motor 12 in the reverse direction. As a result, the mandrel 5 is moved backwardly. Thus, the required product has been manufactured.

As described above, in the embodiment of the invention, when the rough rolling operation is accomplished, the cam 10 is turned in the reverse direction to move backwardly the moving device as much as the amount of retraction R, so that the amount of elongation of the apparatus is set in correspondence to the finish rolling load Pf. The finish rolling operation is carried out under the finish rolling load Pf from the beginning which is steady. Hence, with the apparatus of the invention, the transient period of time which occurs with the conventional apparatus, is eliminated or extremely short. This feature contributes to the shortening of the rolling time.

Furthermore, as described before, the finish rolling operation is carried out under the finish rolling load from the beginning which is steady and low. Hence, although the finish rolling time is short, the resultant workpiece W, or the product, is high in roundness. Therefore, with the apparatus of the invention, unlike the conventional apparatus, it is unnecessary to subject the product thus formed to sizing. That is, with the annular member forming apparatus or method, the workpiece can be rolled with high accuracy although the rolling time is shortened as described above.

The above-described feature that the transient period of time is eliminated or extremely short, makes it possible to allow the threshold value dc to approach the required outside diameter df of the workpiece W.

Furthermore, the embodiment of the invention employs the cam mechanism. Hence, when the mandrel 5 is moved to and from the forming roll 3, its speed is high in accuracy and in response. Therefore, the turning of the cam 10 in the reverse direction when the rough rolling operation is switched over to the finish rolling operation, positively moves backwardly the moving device as much as the amount of retraction R for an extremely short period of time.

Although the mandrel 5 is fed with the cam mechanism in the above-described embodiment, for instance, the mandrel 5 may be moved towards and away from the forming roll 3 with a conventional mechanism such as a thread type feed mechanism and a hydraulic feed mechanism.

However, it should be noted that the employment of the cam mechanism makes it possible to move backwardly the moving device securely as much as the amount of retraction R for an extremely short period of time when the rough rolling operation is switched over to the finish rolling operation.

Furthermore, although the mandrel 5 is moved towards the forming roll 3 in the above-described embodiment, the apparatus may be so modified that the forming roll 3 is moved towards the mandrel 5, or both the mandrel 5 and the forming roll 3 are moved towards and away from each other.

Moreover, the apparatus may be so modified that the mandrel is moved towards the forming roll 3 for the rough rolling operation and the finish rolling operation, and the forming roll 3 is moved backwardly to correct the amount of elastic deformation as much as the amount of retraction R.

In the above-described embodiment, the amount of retraction R is set to a value corresponding to the difference between the amount of elongation of the apparatus which is due to the rolling load Pmax applied thereto at the end of the rough rolling operation and the amount of elongation of the apparatus which is due to the rolling load Pf applied thereto during the finish rolling operation; however, the value may be smaller. In this case, a predetermined transient period of time occurs with the apparatus; however, the amount of elastic deformation is decreased in correspondence to the amount of retraction R, and therefore the transient period of time is shorter than in the case of the conventional apparatus; that is, the working time is shorter as much.

As is apparent from the above description, the annular member forming apparatus and method are advantageous in the following points: The devices employed therein are simple; however, the rolling of the workpiece can be achieved with high accuracy within a short period of time. That is, the apparatus and method of the invention are high in productivity.

What is claimed is:

1. An annular member forming method of forming an annular workpiece which is pressed between a forming roll and a mandrel moved towards and away from each other by a moving device, comprising the steps of:

(a) rough rolling the annular workpiece at a first moving speed of moving the forming roll and the mandrel towards each other;

(b) moving backwardly the moving device away from the mandrel by a predetermined distance; and (c) finish rolling the annular workpiece at a second moving speed which is lower than the first moving speed; and wherein the predetermined distance corresponds to a difference between an amount of elongation which is due to a first rolling load during the step (a) and an amount of elongation which is due to a second rolling load during the step (c).

2. The annular member forming method of claim 1, wherein a rolling load acting on the annular workpiece is decreased as much as an amount of retraction corresponding to the difference in the step (c).

3. A method of forming an annular member comprising the steps of:

providing a rotatable forming roll in contact with an outer cylindrical surface of an annular workpiece;

providing a mandrel movable relatively towards and away from the forming roll and confronting the forming roll in contact with an inner cylindrical surface of the annular workpiece;

providing outside diameter detecting device for detecting an outside diameter of the annular workpiece which is to be worked;

relatively moving the forming roll and the mandrel in a closing direction to sandwich the annular workpiece between the forming roll and the mandrel to subject the annular workpiece to rough rolling and to finishing rolling; and controlling the relative movement of the forming roll and the mandrel so that the moving device relatively moves the forming roll and the mandrel in a separating direction opposite to the closing direction by a predetermined distance during the change from the rough rolling to the finishing rolling, and wherein said predetermined distance is substantially equal to a difference between an elastic deformation of the annular member forming apparatus occurring in the rough rolling and an elastic deformation of the annular member forming apparatus occurring in the finishing rolling.

* * * * *